United States Patent [19]

Krause, Jr.

[11] Patent Number: 4,616,299

[45] Date of Patent: Oct. 7, 1986

[54] ELECTRIC GASLIGHT SIMULATIVE FOR CANDELABRA LIGHT SOCKET

[76] Inventor: A. Frank Krause, Jr., P.O. Box 190, Fairfax City, Va. 22030

[21] Appl. No.: 811,361

[22] Filed: Dec. 20, 1985

Related U.S. Application Data

[63] Continuation-in-part of Ser. No. 671,500, Nov. 15, 1984, Pat. No. 4,577,265.

[51] Int. Cl.[4] ..... F21M 3/14

[52] U.S. Cl. ..... 362/255; 431/125; 431/100

[58] Field of Search ..... 362/255, 186; 431/125, 431/100, 111

[56] References Cited

U.S. PATENT DOCUMENTS 3,148,835 9/1964 Horelick ..... 362/255

*Primary Examiner*—Carroll B. Dority, Jr.
*Attorney, Agent, or Firm*—Harvey B. Jacobson

[57] ABSTRACT

An electric gaslight simulative for installation in an existing candelabra-type light fixture by merely removing the existing bulb and installing the simulative and placing a cylindrical bulb in the socket thereby converting the light fixture into a light which produces a glow or illumination quite similar to that produced by an actual gaslight and having external physical appearance characteristics simulative of an actual gaslight. The simulative includes an adapter body constructed of insulative material positioned on an existing candelabra-type light bulb socket mount and held in place by the generally cylindrical light bulb that telescopes into a generally cylindrical, closed end mantle of glass cloth or similar material with the mantle being supported removably from the adapter body and being supported by a wire frame with both the mantle and wire frame being removable to enable replacement of the elongated cylindrical light bulb. The open end of the mantle is provided with a reinforcing metallic foil tape bonded thereto with the open end of the mantle and tape being received telescopically into a peripheral groove formed in the body of the adapter.

13 Claims, 3 Drawing Figures

ELECTRIC GASLIGHT SIMULATIVE FOR CANDELABRA LIGHT SOCKET

CROSS-REFERENCE TO RELATED APPLICATION

This application is a continuation-in-part of my copending application Ser. No. 671,500 filed on Nov. 15, 1984 for ELECTRIC GASLIGHT SIMULATIVE and now U.S. Pat. No. 4,577,265.

BACKGROUND OF THE INVENTION

1. Field of the Invention

The present invention generally relates to an electric gaslight simulative that can be mounted on existing candelabra light fixtures such as post lamps, entrance lights, hanging fixtures, chandeliers or in any other type of indoor or outdoor light fixture in order to produce a light simulative of a gaslight thereby enabling all of the beneficial appearance characteristics of a gaslight to be enjoyed without requiring actual installation of a gaslight and without requiring a gas supply. The electric gaslight simulative includes an adapter body constructed of insulative material and shaped for positioning on a conventional existing candelabra-type light socket mount which receives the base of a longitudinally elongated tubular bulb that retain the adapter body in place when the bulb is mounted in the socket. A glass cloth mantle is positioned on the bulb with the lower open end of the mantle being provided with a metallic foil tape received in a channel or groove in the adapter body and the outer closed end of the mantle being removably supported from the adapter body by a wire frame of generally U-shaped configuration having the ends of the legs thereof received in sockets provided in laterally extending ears or lugs on the adapter body.

2. Description of Related Art

Prior U.S. Pat. Nos. 1,350,853 and 2,158,304 disclose gas-lighting devices utilizing a mantle of the type generally used in conjunction with a gas flame to produce a gaslight having well known desirable appearance characteristics. U.S. Pat. No. 2,383,116 discloses a screen-like cover attached to a conventional incandescent light bulb and U.S. Pat. No. 3,225,186 discloses a simulative candle associated with various types of light bases.

None of the prior art mentioned above discloses any type of device by which an existing electric candelabra light fixture having one or more existing light sockets therein can be provided with an assembly which simulates a gaslight and produces a light closely simulative of a gaslight.

SUMMARY OF THE INVENTION

An object of the present invention is to provide an electric gaslight simulative in the form of an adapter which can be mounted on an existing candelabra-type light socket mount in an existing light fixture and includes a unique structure for supporting a glass cloth mantle and a longitudinally elongated cylindrical light bulb which produces a light closely simulative in appearance to a gaslight mantle and produces a light having appearance and illumination characteristics simulative of a conventional gaslight thereby enabling an electric light fixture to be quickly and easily converted to a fixture having the appearance characteristics and illumination characteristics of a gaslight.

Another object of the invention is to provide an electric gaslight simulative in which the glass cloth mantle is supported by a generally U-shaped wire frame having the ends of the legs received in sockets provided in the adapter to enable removal of the mantle for replacement of the bulb with the end of the mantle adjacent the adapter being provided with metallic foil tape of gold or other color to reinforce the open end of the mantle and retain it in a peripheral groove or channel provided therefor in the adapter thereby providing a final structure that is attractive in appearance and closely simulative of a gaslight.

A further object of the invention is to provide an electric gaslight simulative in which the adapter and its related components can be constructed of relatively inexpensive components which can be easily and inexpensively assembled thereby retaining the cost of the simulative at a desired reasonable level.

Still another object of the invention is to provide an electric gaslight simulative which can be easily and quickly installed on an existing light socket and can be used in vertically depending or upstanding position or used in any angular position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
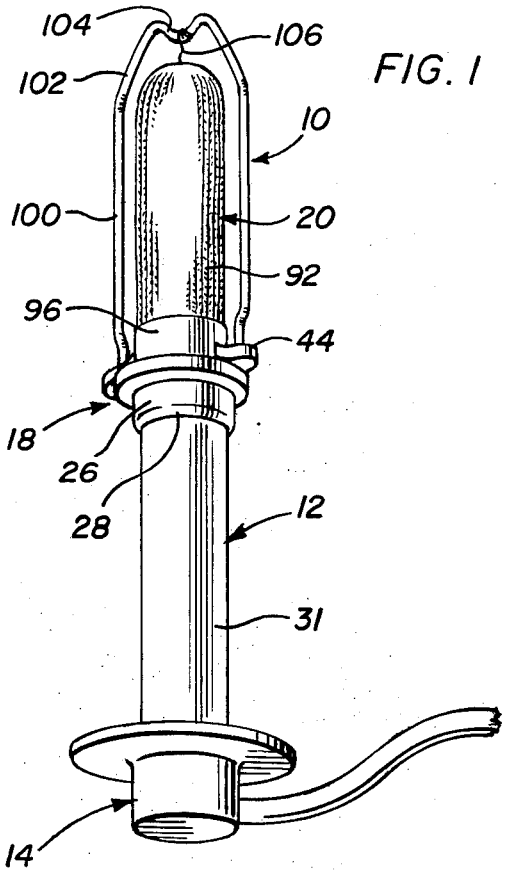
FIG. 1 is a perspective view of the electric gaslight simulative of the present invention illustrating a typical installation in an existing candelabra-type light socket mount of an existing light fixture.

Referring now specifically to the drawings, the electric gaslight simulative of the present invention is generally designated by the numeral 10 and is adapted to be mounted on an existing candelabra-type light socket mount 12 supported by and forming a part of an existing light fixture 14. The light fixture 14 may include a single light socket or multiple light sockets and may be oriented in any position. For example, to light fixture may be incorporated into a post lamp, wall mounted lamp at an entranceway, various hanging fixtures, chandeliers or the like with the simulative 10 of the present invention merely being mounted on the existing light socket mount 12 and held in place by a light bulb.

The electric gaslight simulative 10 includes an adapter 18 supporting a mantle generally designated by the numeral 20 and a wire frame generally designated by the numeral 22 and a light bulb generally designated by the numeral 24.

Figure 3:
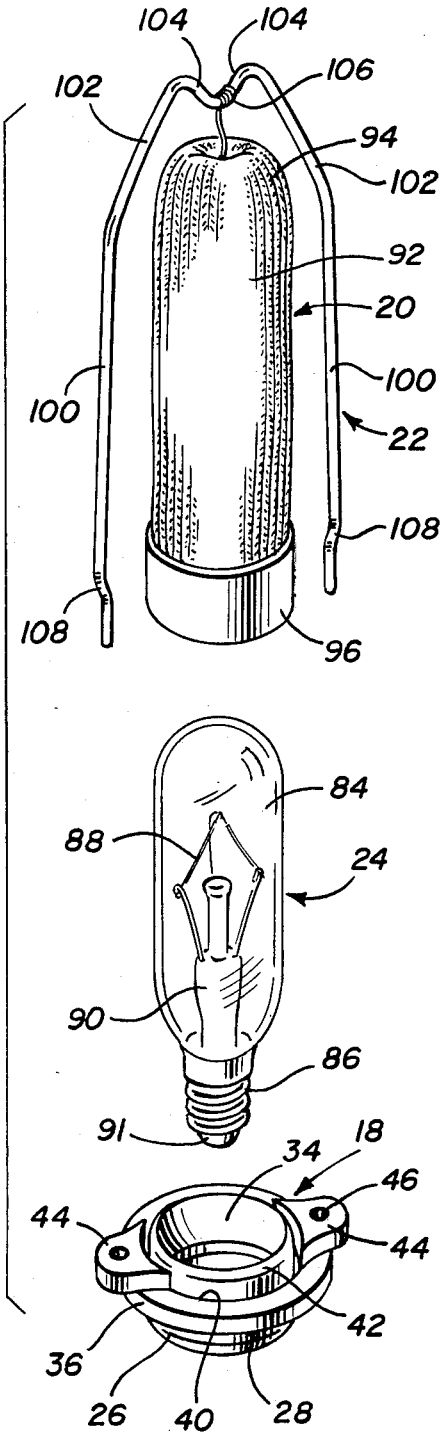
FIG. 3 is an exploded group perspective view of the components of the present invention.
Figure 2:
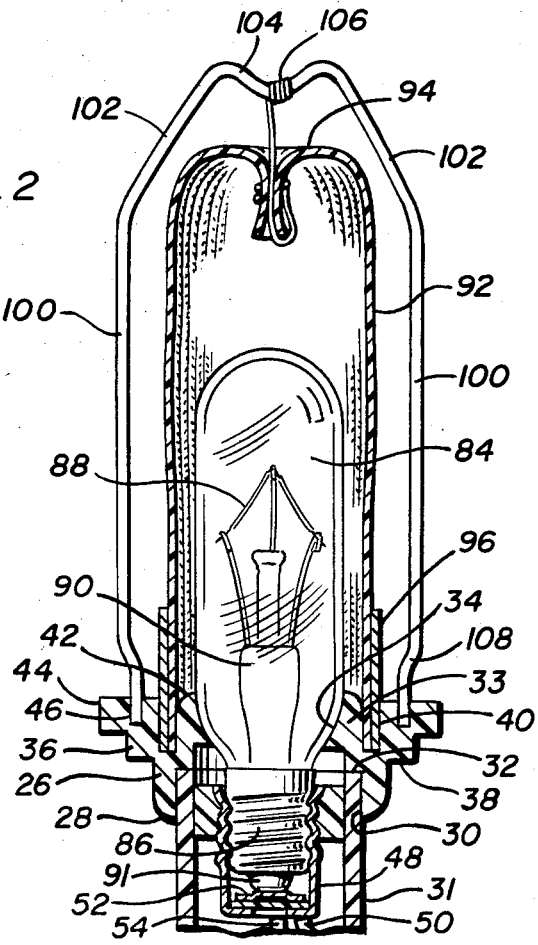
FIG. 2 is a vertical sectional view of the electric gaslight simulative received in an existing candelabra-type light socket mount illustrating the structural details thereof.

The adapter 18 includes a cylindrical body 26 having a rounded lower end surface 28 with a centrally disposed bore 30 which telescopically receives the upper end of a cylindrical plastic sleeve 31 which forms part of the conventional socket mount 12. The cylindrical body 26 includes downwardly facing shoulder 32 in bore 30 which limits insertion of sleeve 31. The outer surface of the body 26 inclines outwardly and includes a cylindrical flange 36 adjacent the upper edge thereof with the external surface of the body 26 including shoulder 38 which forms the lower edge of the flange 36. The upper surface of the flange 36 includes a peripheral upwardly opening channel or groove 40 with the inner wall of the groove 40 being rounded at 42 which extends above the upper surface of the flange 36 and also slightly above a pair of laterally extending ears or lugs 44 which are integral with opposite portions of the upper surface of the flange 36 and have their inner edges defined by the curvature of the groove or channel 40 as illustrated in FIGS. 2 and 3. Each of the ears or lugs 44 is provided with a socket 46 therein for mounting the wire frame 22 in a manner set forth hereinafter with the inner end of the mantle 20 being received in the groove or channel 40 in a manner described hereinafter. The interior surface of the bore 30 above shoulder 32 includes an inwardly extending flange 33 having a concave inner surface 34 conforming with and being engaged with the bulb 24 in a manner described hereinafter. The body 26, including the lugs or ears 44 are of one piece unitary construction and preferably are constructed of conventional insulating material such as plastic or the like.

The candelabra-type socket mount 12 is conventional and includes a screw threaded metallic socket 48 having a bottom 50 provided with a contact 52 which is insulated from the metal socket 48 in a conventional and well known manner with the socket 48 and contact 52 being electrically connected to electric conductors 54 in a conventional manner. Also, the socket 48 is centered in sleeve 31 by spacer 55 all of which is conventional construction.

The light bulb 24 includes an elongated cylindrical transparent envelope 84 which has a rounded outer end and a rounded inner end having a bulb base 86 connected thereto in a conventional manner with the envelope including a filament 88 located adjacent the outer end thereof and a standoff support and insulator 90 to orient the filament 88 adjacent the end of the envelope 84 remote from the base 86 so that the light produced by the light bulb will be oriented nearer the end of the envelope 84 remote from the base 86. The threaded base 86 threads into the socket 48 and makes contact therewith. The contact 91 located centrally of the bulb base 86 and insulated therefrom contacts the contact 52 in socket 48 in a well known manner.

The mantle 20 includes a generally cylindrical or tubular member 92 of woven glass cloth and has a closed outer end 94 and a metallic foil tape 96 encircling the outer surface of the open end of the glass cloth member 92 to reinforce the open end of the mantle and to be received telescopically into the groove or channel 40 as illustrated in FIG. 2 thereby providing a decorative and reflective external surface for the open end portion of the mantle 20 and also reinforcing and stabilizing the open end of the glass cloth member 92 and providing frictional engagement with the walls of the groove 40 to secure the open end of the mantle in position.

The wire frame 22 includes a pair of wire legs 100 having inwardly inclined upper end portions 102 interconnected by a bight portion 104 with the bight portion being of shallow V-shaped configuration with the center of the inwardly extending shallow V being connected to the closed end 94 of the mantle 20 by looped threads 106 which may be of fabric or metallic material. The legs 100 are provided with shallow angulated offset portions 108 at their inner ends and the wire frame is constructed of resilient wire material so that the ends of the legs 100 are spaced apart slightly greater than the distance between the sockets 46 so that in order to insert the ends of the legs into the sockets 46, they must be biased together and then released after insertion to frictionally retain the wire frame in place. This enables easy removal of the wire frame 22 and mantle 20 to replace the bulb 24 when necessary. Also, this enables the adapter 18 to be easily placed on an existing light socket mount 12 in an existing light fixture 14 by removing the existing candelabra bulb and merely placing the body 26 on the socket mount 12 by telescoping it on the sleeve 31 and then screwing the bulb base 86 into the socket 48 until the rounded inner end of the bulb envelope 84 engages firmly against the concave inner surface 34 on flange 33 as shown FIG. 2 thereby securely mounting the body 26 on socket mount 12. The positioning of the light bulb and filament therein with respect to the outer end portion of the mantle 20 produces the desired illumination and closely simulates the physical characteristics of appearance of a gaslight and also produces illumination closely simulative of that produced by a gaslight thereby enabling all of the characteristics of a gaslight to be enjoyed without the necessity of actually installing a gaslight and without the necessity of having a gas supply available.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An assembly to enable an electric light fixture to be converted to a simulated gaslight comprising an adapter having means engaged with the light socket mount on the light fixture and having a bore for a light bulb to extend therethrough and into a socket of said light socket mount, a flexible glass cloth mantle supported from the adapter in a distended position in enclosing relation to a generally cylindrical light bulb whereby illumination of the light bulb will produce a light glow similar to that produced by a gaslight, and means disposed externally of the mantle detachable supporting the mantle from the adapter to enable removal and replacement of the light bulb.

2. The assembly as defined in claim 1 wherein said adapter includes a body of insulative material, and said means supporting said mantle including a supporting wire frame connected to the body and extending alongside the mantle and supporting the outer end of the mantle to simulate a gaslight when the light bulb within the mantle is energized.

3. The assembly of claim 2 wherein said body includes a pair of laterally extending ears having a socket therein, said wire frame including spaced legs having terminal ends frictionally and detachably secured in the sockets in the ears to enable removal of the wire frame and mantle for replacement of the bulb.

4. The assembly as defined in claim 3 wherein said mantle is constructed of flexible glass cloth having a closed outer end, means securing the closed outer end of the mantle to the wire frame, the inner end of the mantle being open and provided with a peripheral reinforcing member to stabilize the open end of the mantle.

5. The assembly as defined in claim 4 wherein the means stablizing the open end of the mantle includes a tape extending peripherally of the open end of the mantle and constructed of metallic foil having a reflective outer surface and an adhesive inner surface for mounting on the mantle.

6. The assembly as defined in claim 5 wherein said body includes a peripheral channel forming an outwardly opening groove telescopically receiving the open end of the mantle with the metallic foil tape being on the outside of the mantle and forming a telescopic friction engagement with the groove in the body.

7. The assembly as defined in claim 6 wherein said light bulb is an elongated generally cylindrical bulb having a filament adjacent the outer end thereof for positioning the source of light adjacent the outer end of the filament thereby closely simulating the glow produced by a gaslight with a mantle.

8. The assembly as defined in claim 1 wherein said adapter comprising a body having said bore therethrough for telescopically receiving the outer end of a plastic tube forming a portion of a candelabra light socket, said cylindrical light bulb including a rigid transparent envelope having a filament therein and a base for mounting in the candelabra light socket, said body including an outwardly facing seat for engagement with the inner end of the envelope of the bulb when it is mounted in the socket for securely mounting the body from the socket.

9. The assembly as defined in claim 8 wherein said bore through the body includes a shoulder limiting insertion of the plastic tube into the body.

10. The assembly as defined in claim 9 wherein said body includes an outwardly facing groove coaxial with the bore for receiving the inner end of the mantle when positioned in enclosing relation to the envelope of the light bulb.

11. The assembly as defined in claim 10 wherein said mantle includes a reinforcing member around the open end thereof for reception in the groove for stabilizing the inner open end of the mantle.

12. The assembly as defined in claim 11 wherein said means supporting said mantle includes a frame mounted on said body and extending outwardly therefrom, means on said frame engaged with and supporting the outer end of said mantle.

13. The assembly as defined in claim 12 wherein said frame is a U-shaped wire frame, said body including a pair of sockets detachably receiving the ends of the legs of the frame to enable replacement of the bulb and mantle.

* * * * *